US008348686B1

(12) United States Patent
Huang

(10) Patent No.: US 8,348,686 B1
(45) Date of Patent: Jan. 8, 2013

(54) PLUG SECURITY STRUCTURE FOR ELECTRICAL CONNECTOR

(76) Inventor: Li-Ping Huang, Taoyuan (TW)

( * ) Notice: Subject to any disclaimer, the term of this patent is extended or adjusted under 35 U.S.C. 154(b) by 0 days.

(21) Appl. No.: 13/270,745

(22) Filed: Oct. 11, 2011

(51) Int. Cl.
*H01R 13/44* (2006.01)

(52) U.S. Cl. ..... 439/133

(58) Field of Classification Search ..... 439/133, 439/676, 541.5, 353
See application file for complete search history.

(56) References Cited

U.S. PATENT DOCUMENTS

| | | | | |
|---|---|---|---|---|
| 4,647,726 | A * | 3/1987 | Blum | 379/435 |
| 6,149,313 | A * | 11/2000 | Giebel et al. | 385/59 |
| 6,682,228 | B2 * | 1/2004 | Rathnam et al. | 385/55 |
| 6,821,024 | B2 | 11/2004 | Bates, III | |
| 7,329,137 | B2 * | 2/2008 | Martin et al. | 439/344 |
| 7,686,638 | B2 * | 3/2010 | Boyd et al. | 439/344 |
| 7,892,012 | B1 | 2/2011 | Foung | |
| 7,976,329 | B2 | 7/2011 | Foung | |
| 8,105,097 | B2 * | 1/2012 | Thijs et al. | 439/148 |
| 2005/0215101 | A1 * | 9/2005 | Pepe | 439/281 |
| 2007/0211998 | A1 * | 9/2007 | Muhlegg et al. | 385/62 |
| 2011/0058773 | A1 * | 3/2011 | Peterhans et al. | 385/76 |
| 2011/0115494 | A1 * | 5/2011 | Taylor et al. | 324/537 |
| 2011/0124217 | A1 * | 5/2011 | Foung | 439/352 |

* cited by examiner

*Primary Examiner* — Neil Abrams
*Assistant Examiner* — Phuongchi Nguyen
(74) *Attorney, Agent, or Firm* — Muncy, Geissler, Olds & Lowe, PLLC

(57) ABSTRACT

A plug security structure includes a plug, a cable, a jacket, a movable cap and a key. By means of a middle block, the movable cap is slidably insertable into sliding grooves in between two upright sidewalls of a front bracket of the jacket to stop the front stop block and to have outer ribs of the elastic retaining members of the movable cap be stopped at rear end edges of the sliding grooves in the upright sidewalls of the front bracket, preventing the latch from downward displacement to unlock the plug from the mating jack and assuring a high level of network data transmission safeness. The cap has a raised portion for friction engagement with the bottom surface of the stop wall of the front bracket of the jacket, preventing vibration or displacement of the movable cap and assuring positive operation of the latch of the plug.

6 Claims, 14 Drawing Sheets

PLUG SECURITY STRUCTURE FOR ELECTRICAL CONNECTOR

BACKGROUND OF THE INVENTION

1. Field of the Invention

The present invention relates to a safety electrical connector design and more particularly, to a plug security structure for electrical connector, which uses a movable cap to lock the latch of the plug, assuring a high level of network data transmission safeness, and which uses a key for insertion into the movable cap for enabling the movable cap to be pulled backwards by the key to unlock the latch of the plug.

2. Description of the Related Art

A modular plug with a latch is known insertable into a mating modular jack to achieve electrical connection. When going to unplug the modular plug from the modular jack, the user must press down the latch to unlock the modular plug from the modular jack. Further, when transmitting data through a connected modular plug and modular jack set, the spring latch of the modular plug may be pressed down accidentally, causing interruption of data transmission.

U.S. Pat. No. 6,821,024 discloses an electrical connector design, entitled "Connector secondary latch". This design includes a housing having a housing body provided with a primary latch that is integrally molded with the housing body and that has a pair of largely rearwardly-facing latch shoulders and a handle that can be depressed to move down the latch shoulders, and a secondary latch that includes a sleeve that extends around the housing body and that can slide forward and rearward thereon, and a wedge part that is wedged between a lower surface of the handle and a top surface of the housing body.

U.S. Pat. No. 7,892,012 discloses a safety electrical connector, entitled "Connector locking device". According to this design, the self-releasing connector locking device comprises a locking tongue support for supporting a locking tongue of a connector, a first retaining mechanism for engaging a portion of a body of a terminal, and a first release arm for releasing the retaining mechanism from the portion of the body of the terminal.

U.S. Pat. No. 7,976,329 discloses a keyed-release connector locking device, which comprises a locking tongue support for supporting a locking tongue of a connector, the locking tongue of the connector consisting of a member biased about a front of the connector on a top surface thereof, extending towards a rear of the connector; a first retaining mechanism for engaging a portion of a body of a terminal, the body of the terminal comprising a structure having a housing on a top surface thereof for receiving the first retaining mechanism; and a key-accessible release arm for releasing the retaining mechanism from the portion of the body of the terminal when pivotably engaged.

SUMMARY OF THE INVENTION

The present invention has been accomplished under the circumstances in view. According to one aspect of the present invention, a plug security structure includes a plug, a cable, a jacket, a movable cap and a key. By means of a middle block, the movable cap is slidably insertable into sliding grooves in between two upright sidewalls of a front bracket of the jacket to stop the front stop block thereof at the bottom side of the latch and to have outer ribs of the elastic retaining members of the movable cap be stopped at rear end edges of the sliding grooves in the upright sidewalls of the front bracket, preventing the latch from downward displacement to unlock the plug from the mating jack and assuring a high level of network data transmission safeness.

Further, the latch can be unlocked and pressed down to disengage the plug from the mating jack for the performance of an examination or maintenance work only after insertion of the key into the movable cap and backward displacement of the movable cap with the key to disengage the front stop block from the latch.

Further, the movable cap has a raised portion for friction engagement with the bottom surface of the stop wall of the front bracket of the jacket, preventing vibration or displacement of the movable cap and assuring positive operation of the latch of the plug.

Further, the front bracket of the jacket has two orthopedically engineered rounded finger grooves respectively located on opposing left and right sides thereof for finger grasping positively and comfortably with less effort.

Further, after insertion of the key into the insertion hole of the movable cap, due to space limitation, retaining blocks of the key are positively forced into engagement with respective retaining groove in the insertion hole of the movable cap. When pulling back the key at this time, the movable cap will be carried by the key to disengage the front stop block of the movable cap from the latch of the plug, allowing the latch to be pressed down to unlock the plug from the mating jack. The two elastic retaining members of the movable cap have a substantially Y-shaped configuration and can be positively and evenly stopped at the respective rear end edges of the respective sliding grooves in the upright sidewalls of the front bracket. Disconnection of the movable cap from the latch of the plug is allowed only after insertion of the assigned key into the movable cap.

Further, as the retaining blocks of the key are respectively located on the top and bottom walls of the key, the user can insert the key into the insertion hole of the movable cap without considering the insertion direction of the key, facilitating operation.

DETAILED DESCRIPTION OF THE INVENTION

Figure 1:
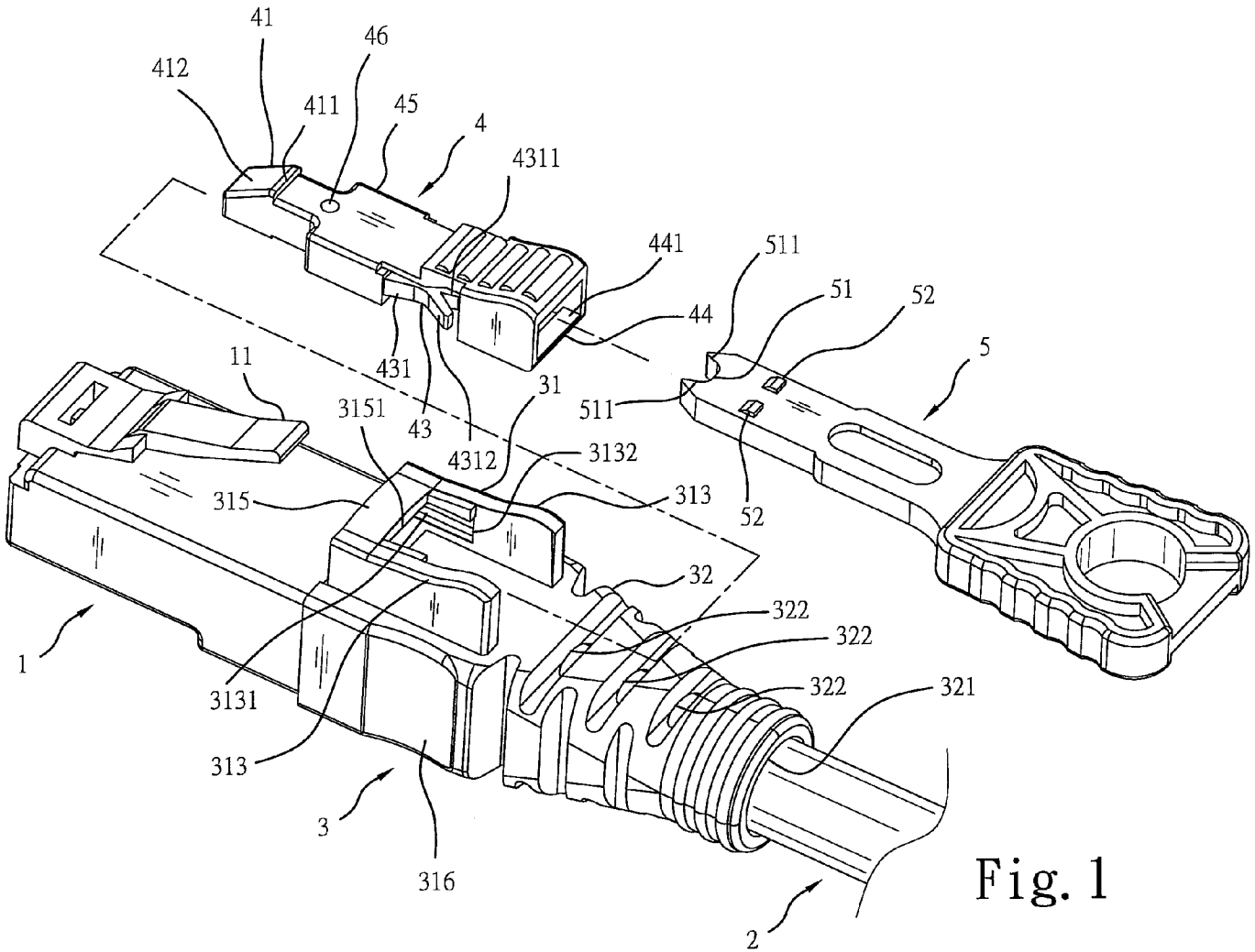
FIG. 1 is an exploded view of a plug security structure in accordance with the present invention.
Figure 2:
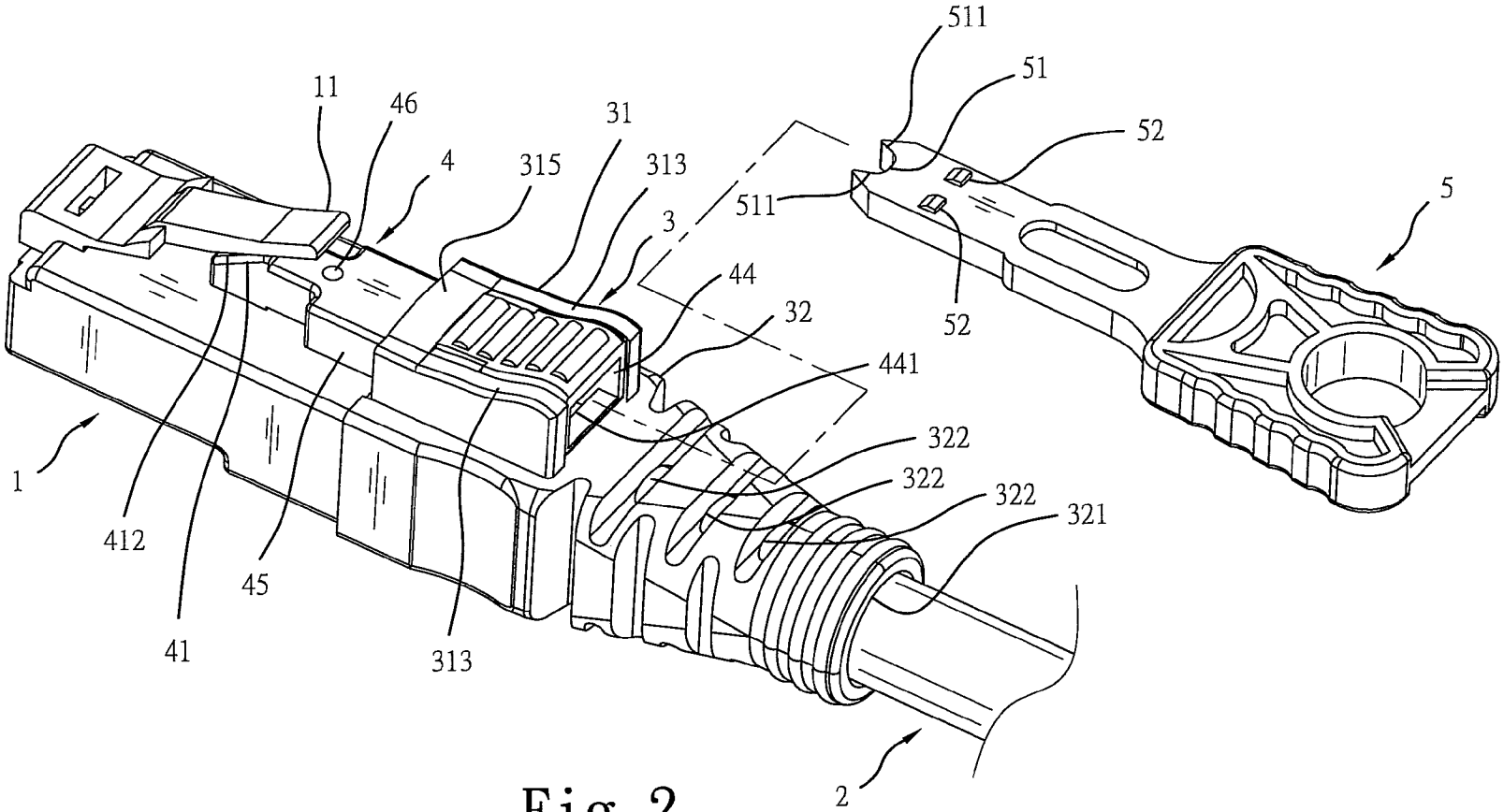
FIG. 2 is an elevational view of the plug security structure in accordance with the present invention before insertion of the key into the cap.
Figure 3:
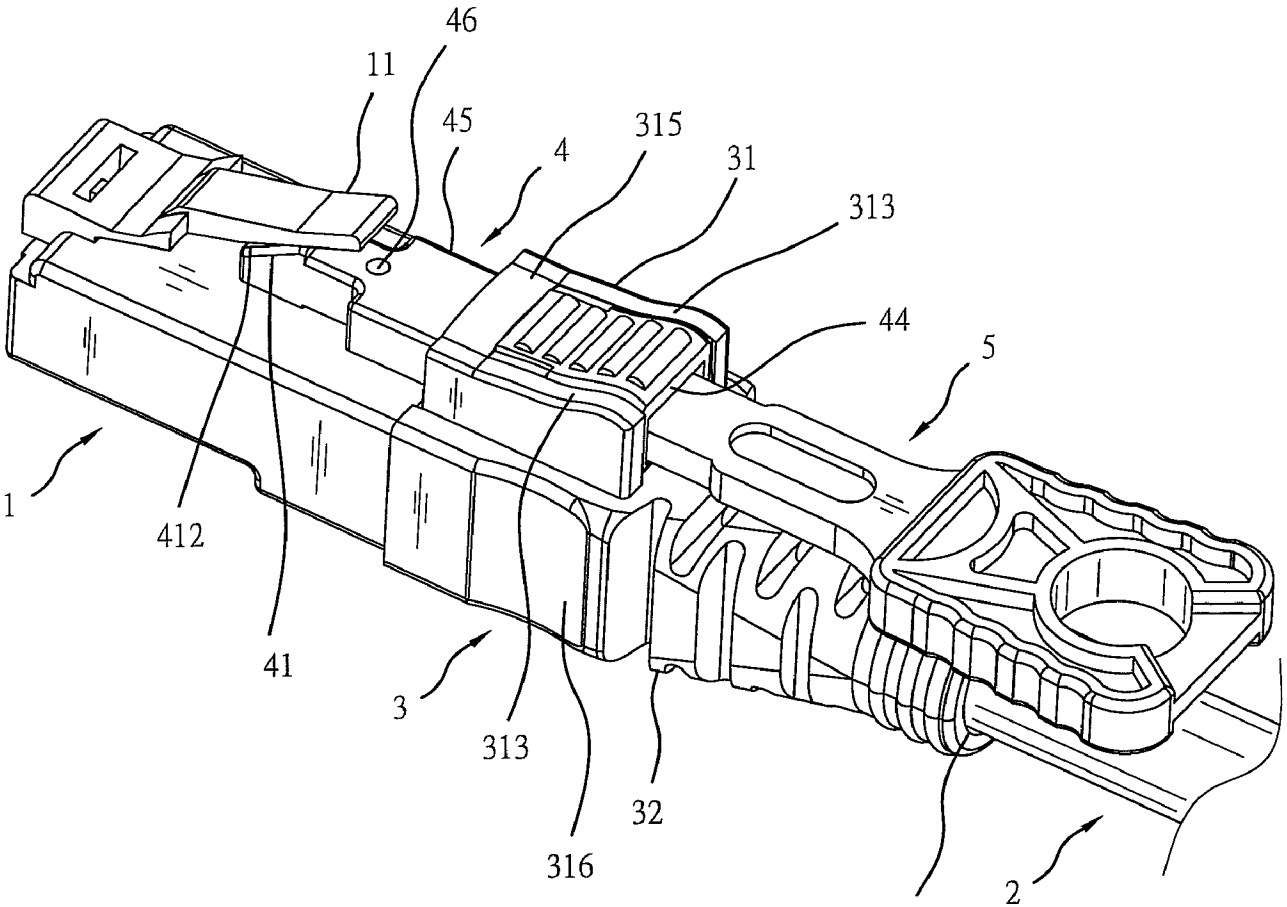
FIG. 3 corresponds to FIG. 2, illustrating the key inserted into the cap.
Figure 4:
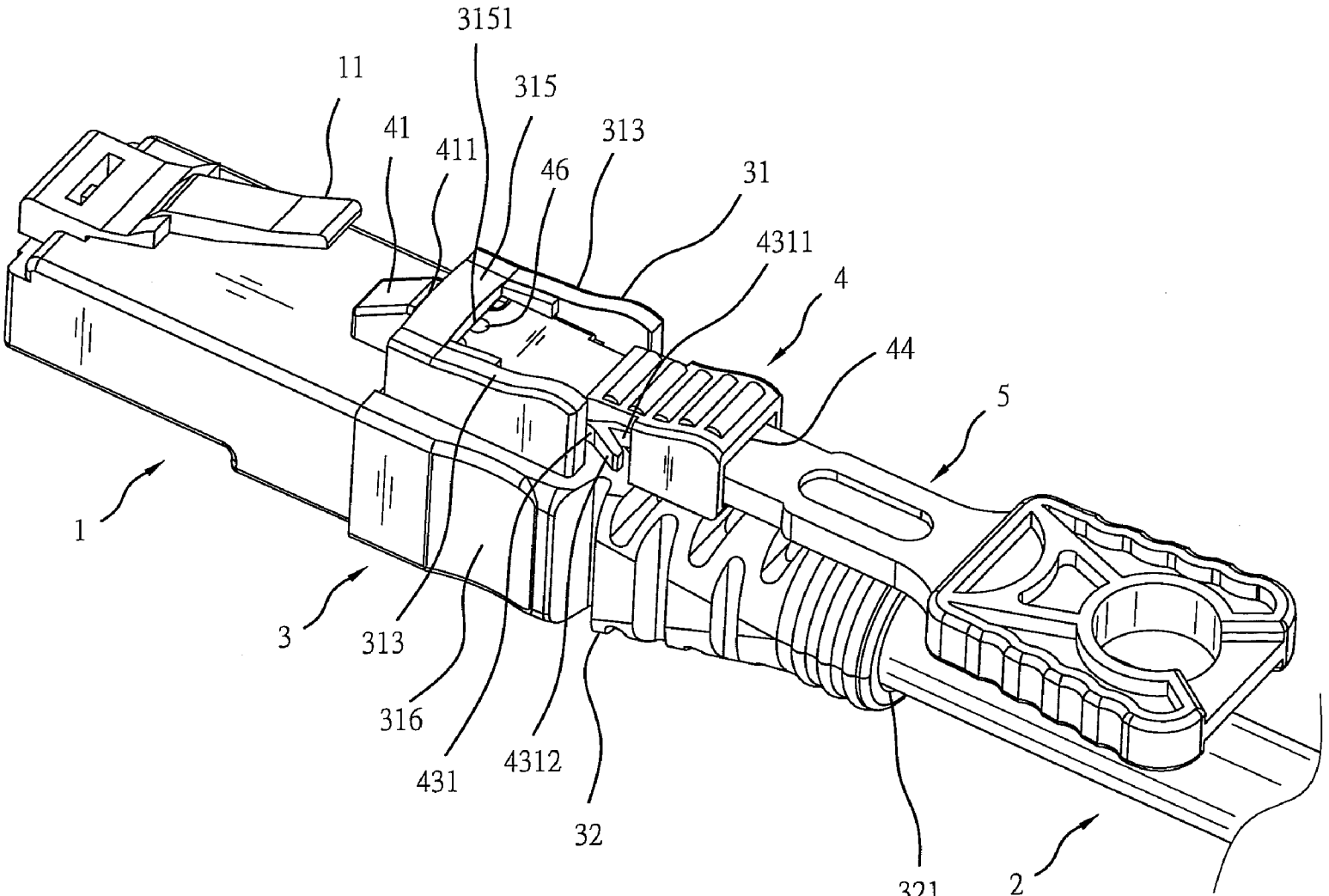
FIG. 4 corresponds to FIG. 3, illustrating the cap pulled backwards.

Referring to FIGS. 1-15, a plug security structure for electrical connector in accordance with the present invention is shown comprising: a plug 1, a cable 2, a jacket 3, a movable cap 4 and a key 5.

The plug 1 is provided with a latch 11.

The cable 2 is inserted through the jacket 3 into the inside of the plug 1 and electrically coupled with the plug 1.

The jacket 3 comprises a front bracket 31 and a rear jacket body 32. The front bracket 31 defines an axial through hole 311. The rear jacket body 32 also defines an axial through hole 321 in communication with the axial through hole 311 for the passing of the cable 2. Further, the front bracket 31 comprises a front connection portion 312 (see FIG. 8) for crimp connection with the plug 1, two upright sidewalls 313 and a sliding groove 3131 defined in each of the two upright sidewalls 313 (see FIG. 1 and FIG. 8).

The movable cap 4 comprises a front stop block 41 for stopping the latch 11 from operation, two openings 42 bilaterally disposed on the middle (see FIG. 9), two elastic retaining members 43 respectively suspending in the two openings 42, each elastic retaining member 43 comprising a support portion 431 and an inner rib 4311 and an outer rib 4312 backwardly extended from the support portion 431 in a forked manner, the outer rib 4312 being stopped by a rear end edge 3132 of the sliding groove 3131 in one of the two upright sidewalls 313 of the front bracket 31 of the jacket 3 (see FIG. 5 and FIG. 6), an insertion hole 44 located on the rear side thereof, a plurality of retaining grooves 441 disposed in the insertion hole 44, a middle block 45 slidably insertable into the sliding grooves 3131 in between the two upright sidewalls 313 of the front bracket 31 of the jacket 3 to stop the front stop block 41 at the bottom side of the latch 11 (see FIG. 12), preventing the latch 11 from downward displacement to unlock the plug from the mating jack (not shown).

Figure 5:
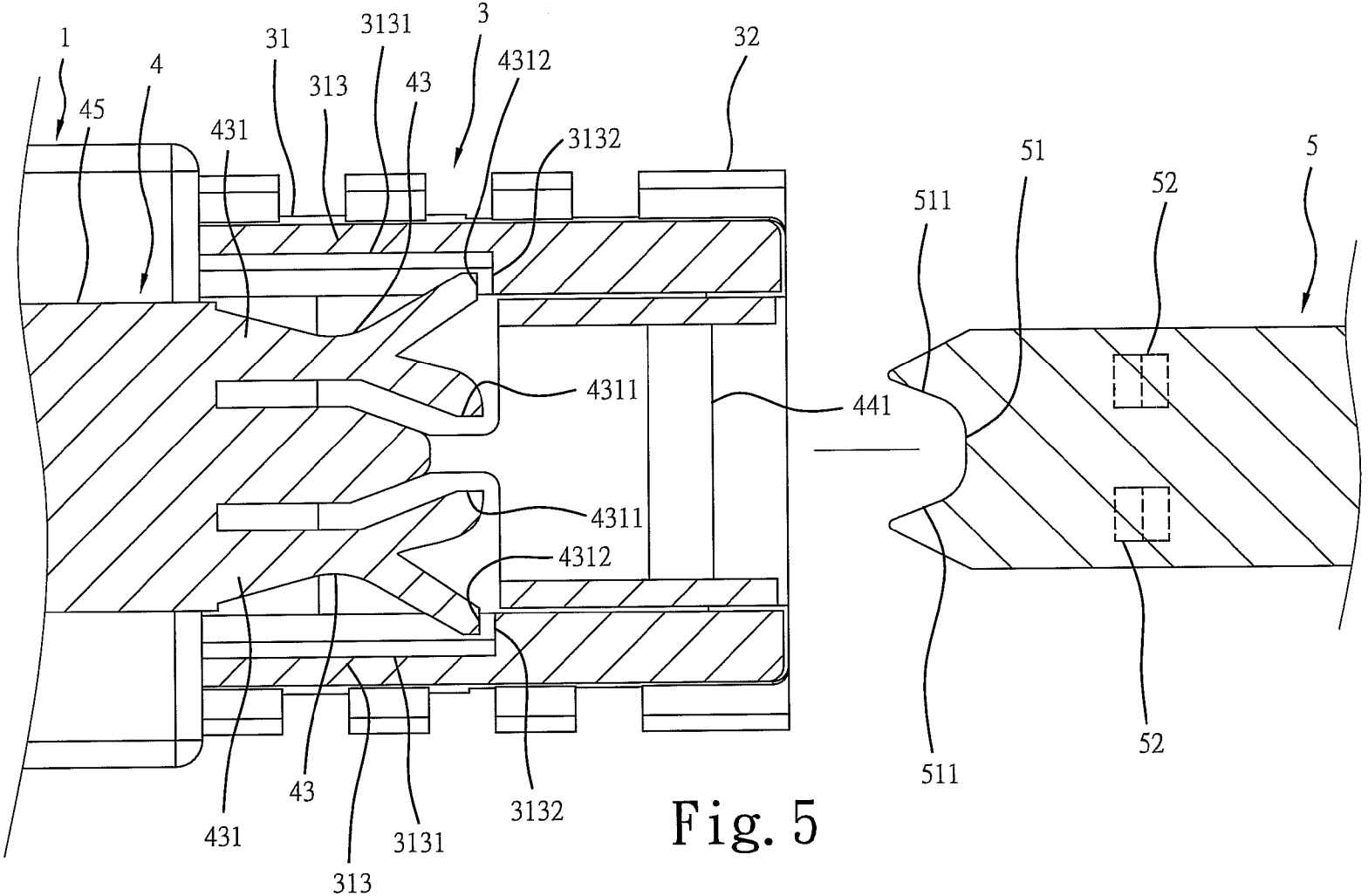
FIG. 5 is a top plain view, in an enlarged scale, of a part of the plug security structure in accordance with the present invention before insertion of the key into the movable cap.
Figure 6:
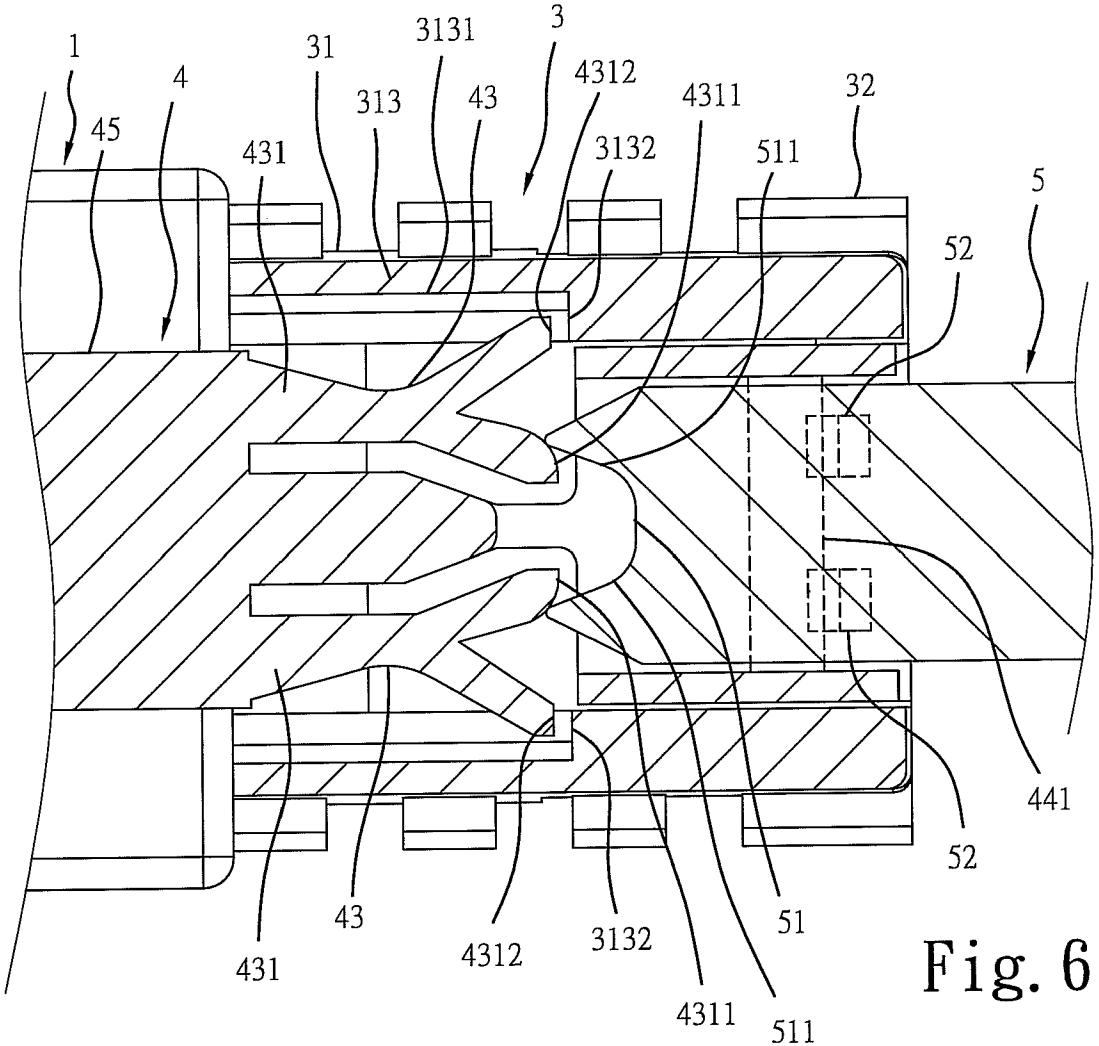
FIG. 6 corresponds to FIG. 5, illustrating the key inserted into the movable cap before displacement of the elastic retaining members of the movable cap.
Figure 7:
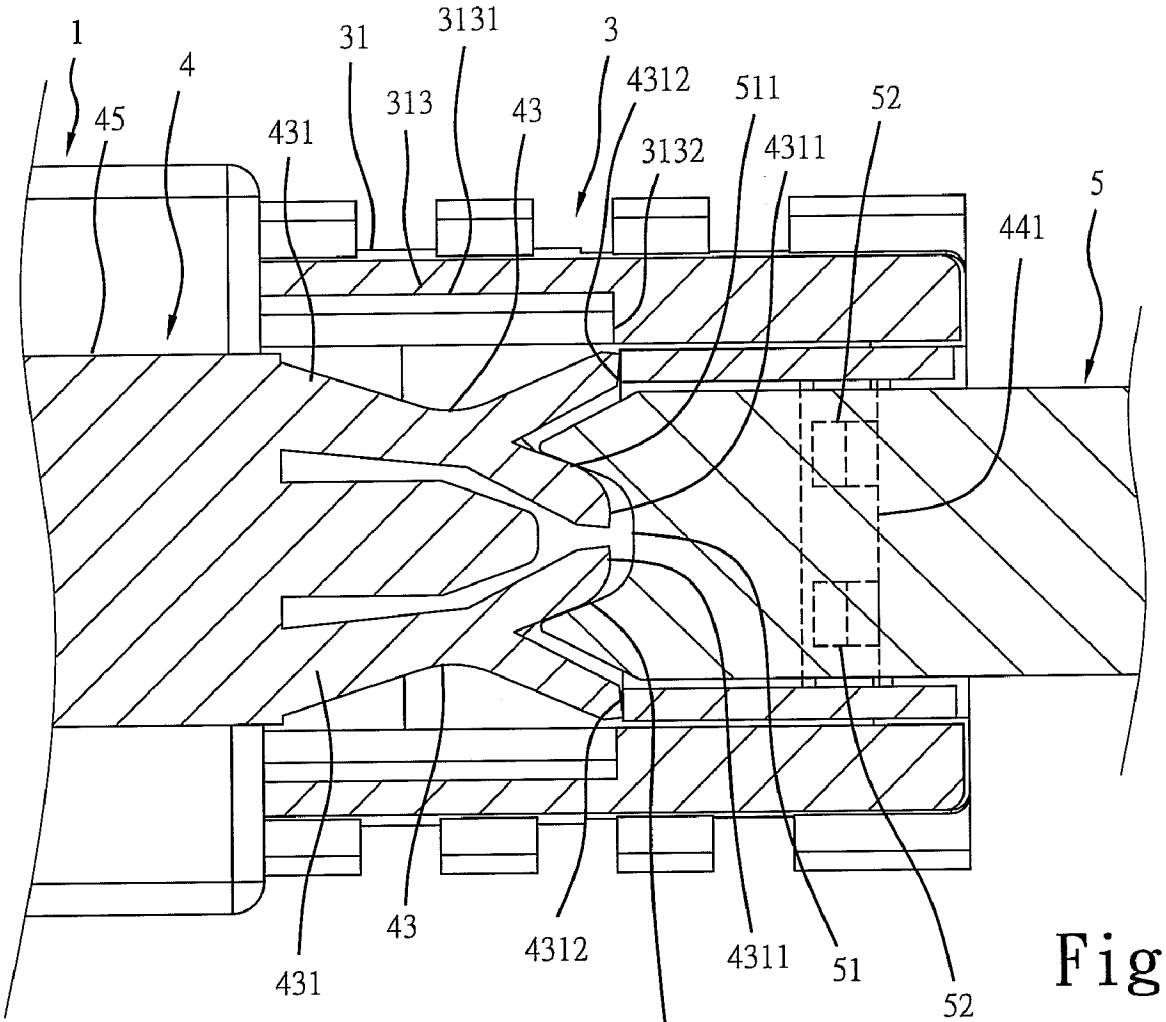
FIG. 7 corresponds to FIG. 6, illustrating the elastic retaining members of the movable cap moved.
Figure 8:
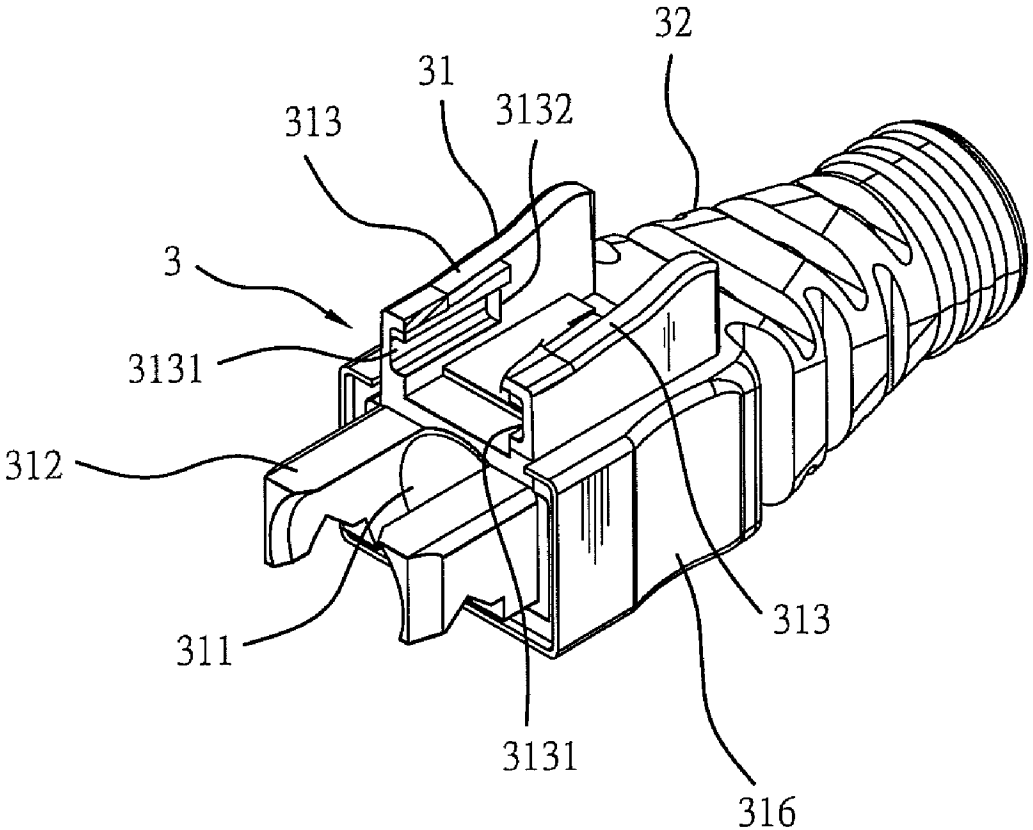
FIG. 8 is an oblique top elevational view of the jacket of the plug security structure in accordance with the present invention.
Figure 9:
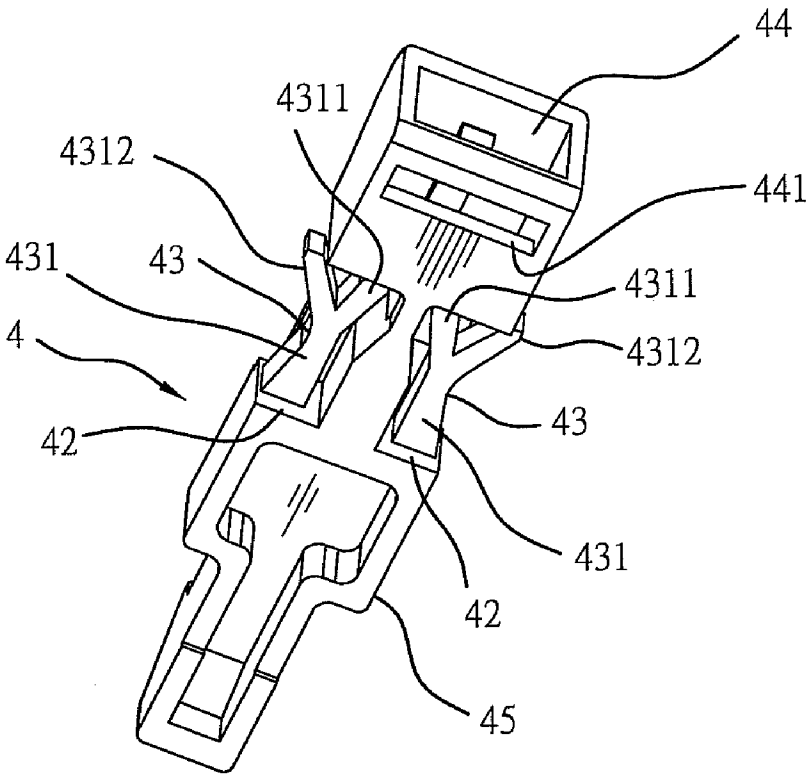
FIG. 9 is an oblique bottom elevational view of the movable cap of the plug security structure in accordance with the present invention.
Figure 10:
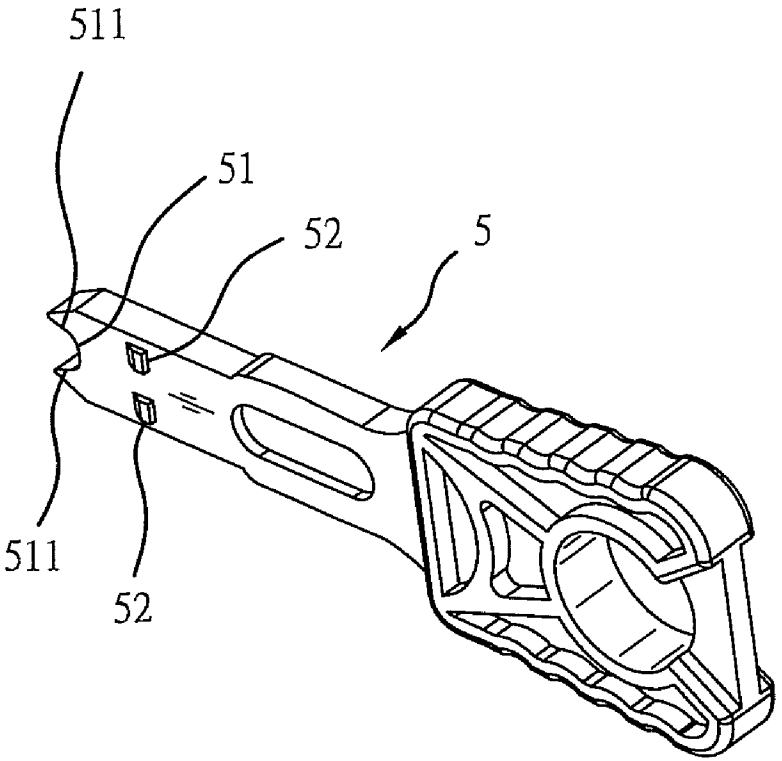
FIG. 10 is an oblique elevational view of the key of the plug security structure in accordance with the present invention.
Figure 11:
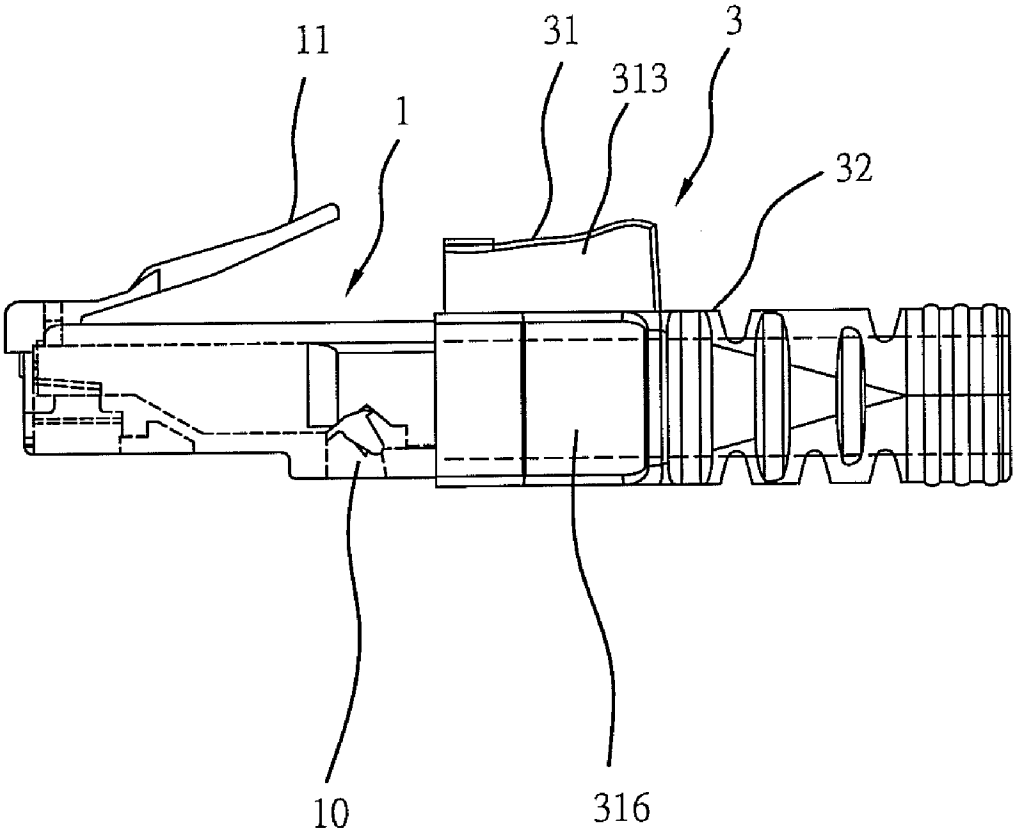
FIG. 11 is a schematic plain view of a part of the present invention, illustrating the relationship between the wire organizer of the plug and the front bracket of the jacket before crimping.
Figure 12:
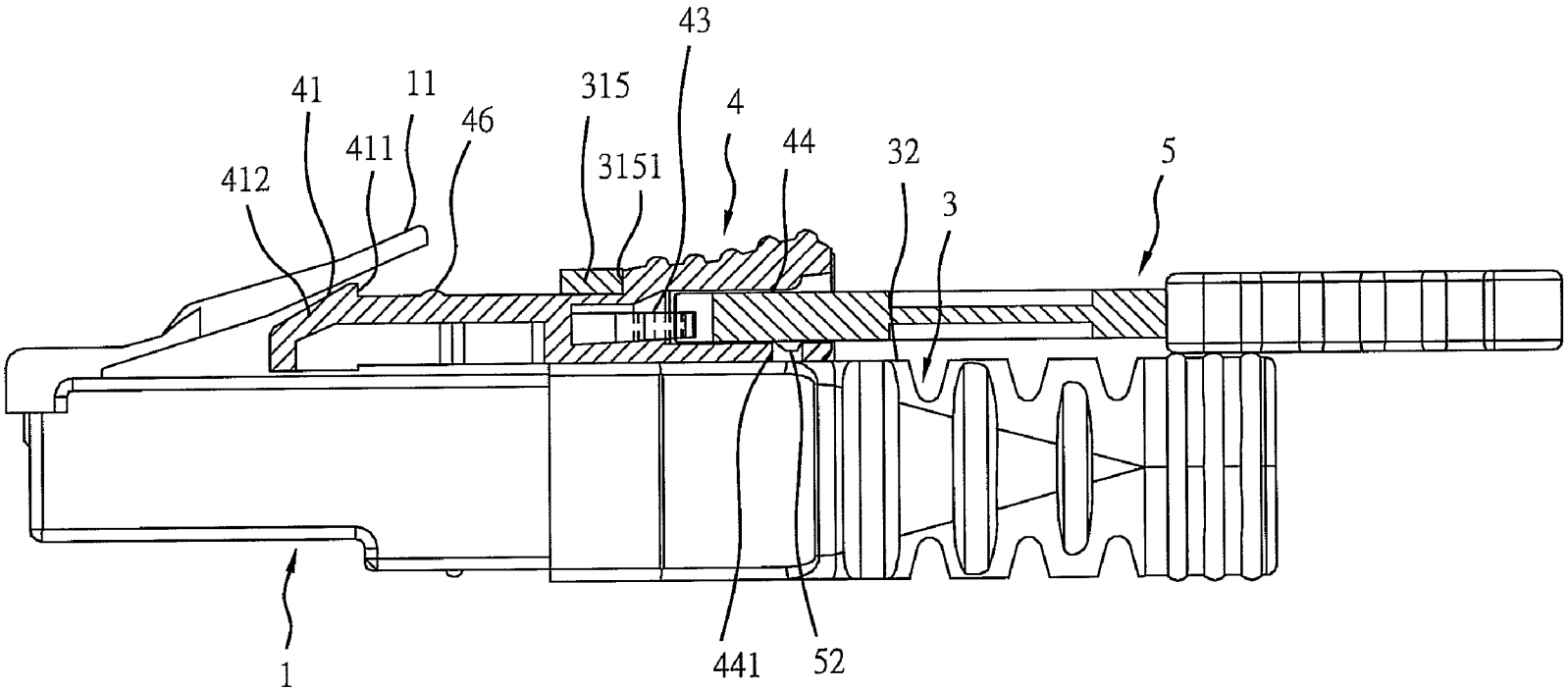
FIG. 12 is a sectional side view of the present invention, illustrating the key inserted into the insertion hole of the movable cap and the retaining blocks of the key engaged with the retaining grooves in the insertion hole of the movable cap.
Figure 13:
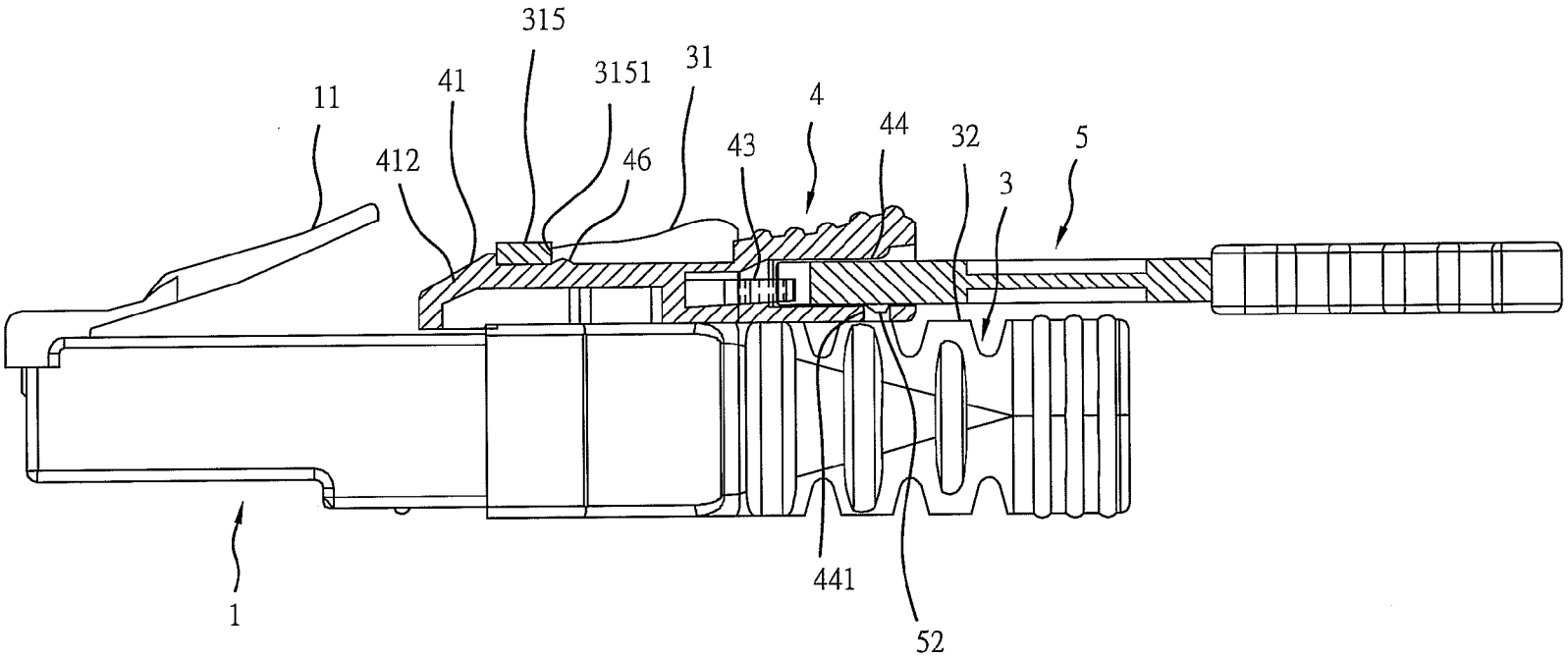
FIG. 13 corresponds to FIG. 12, illustrating the movable cap moved backwardly with the key and disengaged from the latch of the plug.
Figure 15:
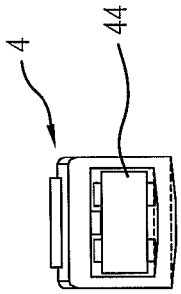
FIG. 15 is a rear end view of the movable cap of the movable cap of the plug security structure in accordance with the present invention.
Figure 14:
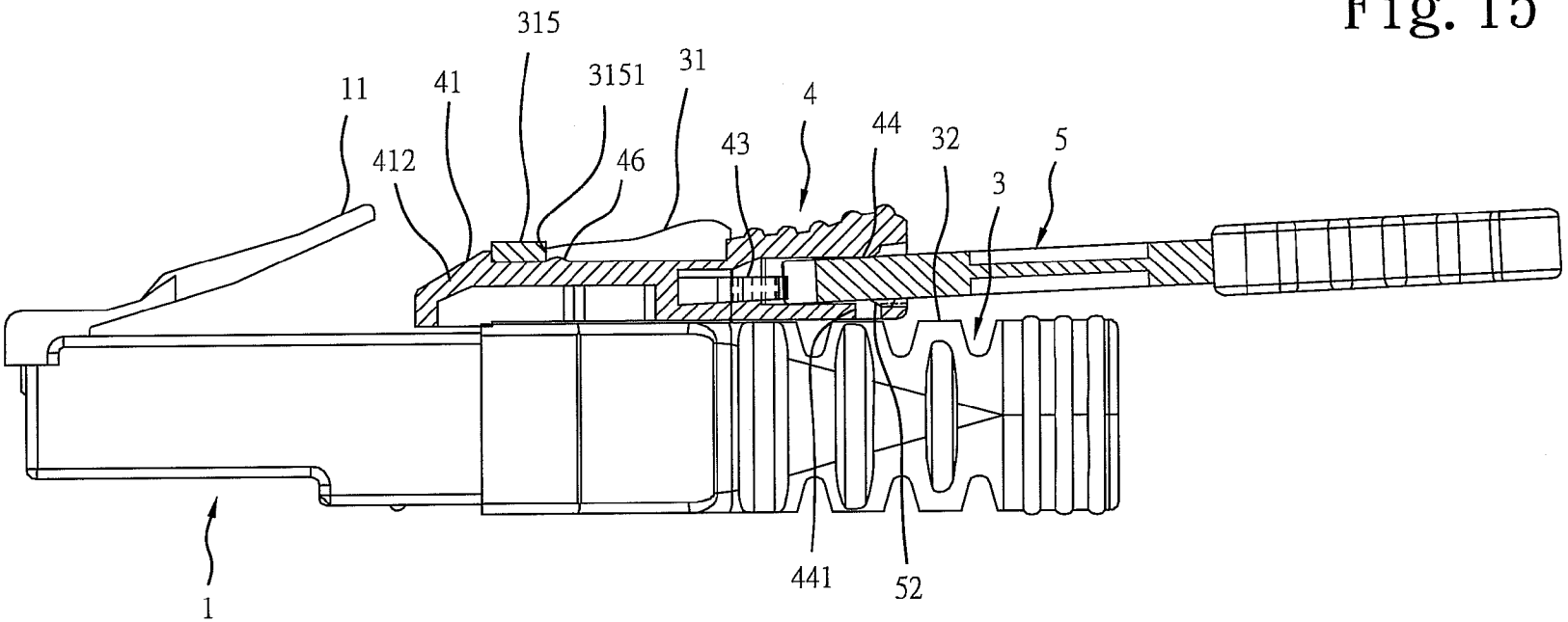
FIG. 14 corresponds to FIG. 13, illustrating the retaining blocks of the key disengaged from the retaining grooves of the movable cap.

The key 5 comprises a front notch 51 defining an inwardly circularly curved inner wall 511, and a plurality of retaining blocks 52 respectively raised from opposing top and bottom walls thereof (see FIG. 1, FIG. 5 and FIG. 10). The key 5 is insertable into the insertion hole 44 of the movable cap 4 to stop the inwardly circularly curved inner wall 511 of front notch 51 against the inner ribs 4311 of the elastic retaining members 43 of the movable cap 4 and to further force the outer ribs 4312 of the elastic retaining members 43 of the movable cap 4 to move toward each other (see FIG. 7) and away from the constraint of the rear end edges 3132 of the sliding grooves 3131 in the two upright sidewalls 313 of the front bracket 31 of the jacket 3. After insertion of the key 5 into the insertion hole 44 of the movable cap 4, the retaining blocks 52 are forced into engagement with the retaining groove 441 in the insertion hole 44 of the movable cap 4 (see FIG. 7 and FIG. 12). When pulling back the key 5 at this time, the movable cap 4 will be carried by the key 5 to disengage the front stop block 41 from the latch 11 of the plug 1 (see FIG. 4 and FIG. 13), allowing the latch 11 to be pressed down to unlock the plug 1 from the mating jack (not shown). Further, as the retaining blocks 52 are respectively located on the top and bottom walls of the key 5, no directional consideration is necessary when inserting the key 5 into the insertion hole 44 of the movable cap 4, facilitating operation.

Further, the front bracket 31 of the jacket 3 further comprises a stop wall 315 transversely connected between the two upright sidewalls 313 at the top side (see FIG. 4, FIG. 12, FIG. 13 and FIG. 14). When the movable cap 4 is carried backwardly by the key 5, a rear end edge 411 of the front stop block 41 of the movable cap 4 will be stopped by the stop wall 315 to prevent falling of the movable cap 4 out of the front bracket 31 of the jacket 3.

The movable cap 4 further comprises a raised portion 46 located on the top wall thereof for friction engagement with the bottom surface 3151 of the stop wall 315 of the front bracket 31 of the jacket 3 (see FIG. 4 and FIG. 13), preventing vibration or displacement of the movable cap 4 and assuring positive operation of the latch 11 of the plug 1.

Further, the front bracket 31 of the jacket 3 comprises two orthopedically engineered rounded finger grooves 316 respectively symmetrically located on the opposing left and right sides thereof for finger grasping positively and comfortably with less effort.

Further, the rear jacket body 32 of the jack 3 has a plurality of transverse grooves 322 located on the periphery and kept in communication with the axial through hole 321 (see FIG. 1 and FIG. 2), enhancing flexibility and sense of beauty of the rear jacket body 32.

Further, the front stop block 41 of the movable cap 4 comprises a beveled face 412 for abutting against the bottom wall of the latch 11 positively. Thus, when the latch 11 of the plug 1 is locked by the front stop block 41 of the movable cap 4, the plug 1 can be positively inserted into the mating jack (not shown), providing excellent elasticity and forgiveness.

Further, the front bracket 31 of the jacket 3 can be made of hard polycarbonate. Further, the rear jacket body 32 of the jacket 3 can be made of flexible polyvinyl chloride. After molding of the front bracket 31 and the rear jacket body 32, the jacket 3 achieves harmony between function and appearance.

Further, after crimp connection between the wire organizer 10 of the plug 1 and the front bracket 31 of the jacket 3, no further molding is necessary, facilitating installation and saving much installation time and labor.

Further, the design of the inwardly circularly curved inner wall 511 (smiling curve) of the front notch 51 of the key 5 makes the invention not easy to be imitated.

In conclusion, the invention provides a latch security structure that has advantages and features as follows:

1. By means of the middle block 45, the movable cap 4 can be slidably inserted into the sliding grooves 3131 in between the two upright sidewalls 313 of the front bracket 31 of the jacket 3 to stop the front stop block 41 at the bottom side of the latch 11 and to have the outer ribs 4312 of the elastic retaining members 43 of the movable cap 4 be stopped at the rear end edges 3132 of the sliding grooves 3131 in the two upright sidewalls 313 of the front bracket 31 of the jacket 3, preventing the latch 11 from downward displacement to unlock the plug from the mating jack and assuring a high level of network data transmission safeness.

2. The latch 11 can be unlocked and pressed down to disengage the plug 1 from the mating jack for the performance of an examination or maintenance work only after insertion of the key 5 into the movable cap 4 and backward displacement of the movable cap 4 with the key 5 to disengage the front stop block 41 from the latch 11.

3. When inserting the key 5 into the insertion hole 44 of the movable cap 4, the inwardly circularly curved inner wall 511 of front notch 51 will be accurately forced against the inner ribs 4311 of the elastic retaining members 43 of the movable cap 4 and to further force the outer ribs 4312 of the elastic retaining members 43 of the movable cap 4 inwardly away from the rear end edges 3132 of the sliding grooves 3131 in the two upright sidewalls 313 of the front bracket 31 of the jacket 3.

4. As the retaining blocks 52 of the key 5 are respectively located on the top and bottom walls of the key 5, the user can insert the key 5 into the insertion hole 44 of the movable cap 4 without considering the insertion direction of the key 5, facilitating operation.

5. The key 5 and the front bracket 31 and rear jacket body 32 of the jacket 3 are made of plastic materials by injection-molding. Thus, the invention is suitable for mass production, reducing the cost, facilitating installation, saving much installation time and labor and enhancing product competitiveness.

6. The two elastic retaining members 43 of the movable cap 4 have a substantially Y-shaped configuration and can be positively and evenly stopped at the respective rear end edges 3132 of the respective sliding grooves 3131 in the upright sidewalls 313 of the front bracket 31. Only after insertion of the assigned key 5 into the movable cap 4 allows disconnection of the movable cap 4 from the latch 11 of the plug 1.

7. The rounded finger grooves 316 of the front bracket 31 of the jacket 3 are orthopedically engineered for finger grasping positively and comfortably with less effort.

8. The transverse grooves 322 of the rear jacket body 32 of the jack 3 are located on the periphery of the rear jacket body 32 and kept in communication with the axial through hole 321, enhancing flexibility and sense of beauty of the rear jacket body 32.

9. The beveled face 412 of the front stop block 41 of the movable cap 4 is configured for abutting against the bottom wall of the latch 11 positively. Thus, when the latch 11 of the plug 1 is locked by the front stop block 41 of the movable cap 4, the plug 1 can be positively inserted into the mating jack, providing excellent elasticity and forgiveness.

10. The raised portion 46 of the movable cap 4 is disposed at the top side for friction engagement with the bottom surface 3151 of the stop wall 315 of the front bracket 31 of the jacket 3, preventing vibration or displacement of the movable cap 4 and assuring positive operation of the latch 11 of the plug 1.

11. The front bracket 31 and rear jacket body 32 of the jacket 3 can be respectively made of hard polycarbonate and flexible polyvinyl chloride. After molding of the front bracket 31 and the rear jacket body 32, the jacket 3 achieves harmony between function and appearance.

12. After crimp connection between the wire organizer 10 of the plug 1 and the front bracket 31 of the jacket 3, no further molding is necessary, facilitating installation and saving much installation time and labor.

13. The design of the inwardly circularly curved inner wall 511 (smiling curve) of the front notch 51 of the key 5 makes the invention not easy to be imitated.

14. After insertion of the key 5 into the insertion hole 44 of the movable cap 4, due to space limitation, the retaining blocks 52 are positively forced into engagement with the retaining groove 441 in the insertion hole 44 of the movable cap 4 (see FIG. 3, FIG. 7 and FIG. 12). When pulling back the key 5 at this time, the movable cap 4 will be carried by the key 5 to disengage the front stop block 41 from the latch 11 of the plug 1 (see FIG. 4 and FIG. 13), allowing the latch 11 to be pressed down to unlock the plug 1 from the mating jack. Further, the bottom wall of the movable cap 4 is elastic (see FIG. 15), the retaining blocks 52 can easily be moved away from the retaining groove 441 in the insertion hole 44 of the movable cap 4 (see FIG. 14) when the user pulls the key 5 out of the movable cap 4, facilitating the use of the present invention.

What is claimed is:

1. A plug security structure, comprising:

a plug comprising a latch;

a cable inserted through a jacket into the inside of said plug and electrically coupled with said plug;

a jacket comprises a front bracket and a rear jacket body, said front bracket defining an axial through hole, said rear jacket body defining an axial through hole in communication with the axial through hole of said front bracket for the passing of said cable, said front bracket comprises a front connection portion for crimp connection with the plug, two upright sidewalls, a sliding groove defined in each said upright sidewall and a stop wall transversely connected between said two upright sidewalls at a top side;

a movable cap comprising a front stop block for stopping said latch from operation, two openings bilaterally disposed on a middle part thereof, two elastic retaining members respectively suspending in said two openings, each said elastic retaining member comprising a support portion and an inner rib and an outer rib backwardly extended from said support portion in a forked manner, said outer rib being stopped by a rear end edge of the sliding groove in one said upright sidewall of said front bracket of said jacket, an insertion hole located on a rear side thereof, a middle block slidably insertable into the sliding grooves in said upright sidewalls of said front bracket of said jacket to stop said front stop block at the bottom side of said latch; and a key comprising a front notch defining an inwardly circularly curved inner wall for stopping against the inner ribs of the elastic retaining members of said movable cap to further force the outer ribs of said elastic retaining members of said movable cap toward each other and away from the constraint of the rear end edges of the sliding grooves in the two upright sidewalls of said front bracket of said jacket.

2. The plug security structure as claimed in claim 1, wherein said movable cap further comprises a plurality of retaining grooves disposed in said insertion hole; said key further comprises a plurality of retaining blocks respectively raised from opposing top and bottom walls thereof for engagement with the retaining grooves in the insertion hole of said movable cap after insertion of said key into said insertion hole of said movable cap.

3. The plug security structure as claimed in claim 1, wherein said front bracket of said jacket comprises two orthopedically engineered rounded finger grooves respectively symmetrically located on opposing left and right sides thereof for finger grasping.

4. The plug security structure as claimed in claim 1, wherein said rear jacket body of said jack comprises a plurality of transverse grooves located on the periphery thereof and kept in communication with the axial through hole of said rear jacket body.

5. The plug security structure as claimed in claim 1, wherein said front stop block of the movable cap comprises a beveled face for abutting against the bottom wall of said latch positively.

6. The plug security structure as claimed in claim 1, wherein said front bracket of the jacket is made of hard polycarbonate.

* * * * *